US007438668B1

(12) United States Patent
Watry et al.

(10) Patent No.: US 7,438,668 B1
(45) Date of Patent: Oct. 21, 2008

(54) HURDLE

(75) Inventors: Jeffrey P. Watry, Penfield, IL (US); Audrea C. Wall, Urbana, IL (US)

(73) Assignee: Gill Athletics, Inc., Champaign, IL (US)

( * ) Notice: Subject to any disclaimer, the term of this patent is extended or adjusted under 35 U.S.C. 154(b) by 680 days.

(21) Appl. No.: 11/205,660

(22) Filed: Aug. 17, 2005

Related U.S. Application Data

(60) Provisional application No. 60/602,916, filed on Aug. 19, 2004.

(51) Int. Cl.
*A63B 5/02* (2006.01)

(52) U.S. Cl. ..... 482/17; 482/908; 403/109.3; 403/109.7

(58) Field of Classification Search ..... 482/14–17, 482/38–42, 148, 908; 119/705; 403/108, 403/109.1, 109.2, 109.3, 109.7, 109.8; 248/326
See application file for complete search history.

(56) References Cited

U.S. PATENT DOCUMENTS 1,561,186 A * 11/1925 Reach ..... 482/17
1,887,033 A * 11/1932 Merriman ..... 482/17
1,902,995 A * 3/1933 Flynn ..... 119/705
1,982,934 A * 12/1934 Squire ..... 482/16
2,119,808 A * 6/1938 Fecht ..... 482/16
2,445,543 A * 7/1948 Hubert ..... 248/354.7
2,583,786 A * 1/1952 Marzucco ..... 482/17
2,706,631 A * 4/1955 Holmes ..... 482/17
2,932,510 A * 4/1960 Kravitz ..... 482/38
3,366,381 A * 1/1968 Ross ..... 482/17
3,384,367 A * 5/1968 Baum ..... 482/17
3,394,932 A * 7/1968 Leflar ..... 482/17
4,596,388 A * 6/1986 Burden ..... 482/16
4,749,187 A 6/1988 Dellinger et al. ..... 272/103
4,932,653 A * 6/1990 Schwartz et al. ..... 482/96
5,005,828 A * 4/1991 Sauerbrey ..... 482/17
5,033,737 A * 7/1991 Moye ..... 482/17
5,152,727 A * 10/1992 Moore et al. ..... 482/15
5,199,930 A * 4/1993 Weber ..... 482/17
5,226,680 A * 7/1993 Bahner et al. ..... 285/93
5,334,119 A * 8/1994 Eloranta ..... 482/16
5,334,121 A * 8/1994 McPhilomy ..... 482/17
5,341,829 A * 8/1994 Hsiao et al. ..... 135/68
5,349,977 A * 9/1994 Wood ..... 135/67

(Continued)

FOREIGN PATENT DOCUMENTS

DE 4322756 A1 * 1/1995

*Primary Examiner*—Loan H Thanh
*Assistant Examiner*—Daniel F Roland
(74) *Attorney, Agent, or Firm*—Philip L. Bateman

(57) ABSTRACT

A hurdle has contiguous trigger tubes along the telescoping tubes. A trigger mechanism inside each trigger tube is used to adjust the height of the hurdle. The trigger mechanism contains a pivoting vertical rod with an inwardly directed perpendicular upper end that extends out of the hole in the trigger tube to form a button and an outwardly directed perpendicular pin at its lower end that engages one of the holes in the upright. The vertical rod has a horizontal pivot bar attached midway along its outward surface. The lower end of the vertical rod is connected to a spring compressed within the trigger tube that forces the pin inwardly and that is further compressed when the button is pushed to release the pin.

10 Claims, 7 Drawing Sheets

U.S. PATENT DOCUMENTS 5,352,057 A * 10/1994 Zody ..... 403/109.3
5,462,380 A * 10/1995 Peek et al. ..... 403/329
5,662,556 A * 9/1997 Gangloff ..... 482/38
5,842,954 A * 12/1998 Slupskiy ..... 482/15
5,989,158 A * 11/1999 Fredette ..... 482/38
6,063,005 A * 5/2000 Schwartz ..... 482/16
6,715,448 B1 * 4/2004 McComb ..... 119/705
7,097,380 B2 * 8/2006 Lee ..... 403/109.2
7,182,223 B2 * 2/2007 Healy et al. ..... 222/174
7,222,892 B2 * 5/2007 Guidetti ..... 292/306
7,334,957 B2 * 2/2008 Sadinsky et al. ..... 403/109.3
2002/0115534 A1 * 8/2002 Chen Wu ..... 482/15

* cited by examiner

HURDLE

CROSS-REFERENCE TO RELATED APPLICATION

This application claims the benefit of U.S. Provisional Application Ser. No. 60/602,916, filed Aug. 19, 2004.

FIELD OF THE INVENTION

This invention relates to track and field equipment. More particularly, this invention relates to hurdles.

BACKGROUND OF THE INVENTION

Track and field is a sport in which athletes compete in running, jumping, and throwing events. In two events that combine running and jumping, the athletes jump over ten spaced apart hurdles in between the start and finish. A hurdle consists of a base, two uprights, and a horizontal gateboard. In the first hurdle event (commonly known as the high hurdles), athletes run about 100 yards and jump over relatively high hurdles. In the second hurdle event (commonly known as the low or intermediate hurdles), athletes run about 440 yards and jump over lower hurdles. The height of the hurdle in each of the events varies depending upon the age and sex of the athletes. For versatility and economy, most hurdles are adjustable in height.

A hurdle is designed to tip over if the athlete's foot or knee contacts it. In terms of physics, the hurdle tips when the torque applied to the gateboard is sufficient. Torque is defined as the force multiplied by the distance from the axis. The force at the gateboard required to tip the hurdle over is commonly known as its pull over weight. The pull over weight is a function of the height of the hurdle (the distance from the gateboard to the axis). Other things being equal, the pull over weight decreases as the height of the hurdle increases. Most hurdles contain added weights in the base to achieve the desired pull over weight. To maintain a constant pull over weight as the height of the hurdle changes, many modern hurdles incorporate a weight that moves in the base. As the height of the hurdle increases, the weight is moved further away from the uprights and, as the height of the hurdle decreases, the weight is moved toward the uprights. In some hurdles, the weight is moved manually. In other hurdles, the weight is connected mechanically to the gateboard so that it moves automatically as the gateboard is moved.

A hurdle with a movable weight connected to the gateboard is disclosed in Dellinger et al., U.S. Pat. No. 4,749,187, issued Jun. 7, 1988, which is incorporated by reference. The Dellinger et al. hurdle contains weights inside the base that are connected to the gateboard by a mechanical system consisting of cables, pulleys, and springs. The gateboard height and the positions of the weights are adjusted using a trigger mechanism located in the uprights. The spring and the trigger mechanism occasionally require service and, because of their locations, are difficult to repair.

Accordingly, a demand exists for an improved hurdle. In particular, a demand exists for a hurdle that contains a durable and easily used trigger mechanism that is not contained within the upright itself. A demand also exists for a hurdle with automatically movable weights connected to springs that are not contained within the base.

SUMMARY OF THE INVENTION

The general object of this invention is to provide an improved hurdle. A more particular object is to provide a hurdle that contains a durable and easily used trigger mechanism that is not contained within the upright.

We have invented an improved hurdle. The hurdle comprises: (a) a base comprising two parallel horizontal legs, each leg having a leading end and a trailing end, and a horizontal cross support; (b) two uprights, each upright having an inward surface and extending upwardly from the trailing end of a leg and having a plurality of holes spaced apart vertically along its inward surface; (c) two telescoping tubes, each tube having a top end and being adapted to fit over an upright, each tube having a contiguous trigger tube along its inward surface, each trigger tube having an inward surface and having a hole along its inward surface; (d) a gateboard connecting the top ends of the telescoping tubes; and (e) a trigger mechanism inside each trigger tube, each trigger mechanism comprising a pivoting vertical rod with an inwardly directed perpendicular upper end that extends out of the hole in the trigger tube to form a button and an outwardly directed perpendicular pin at its lower end that engages one of the holes in the upright, the vertical rod having a horizontal pivot bar attached midway along its outward surface, the lower end of the vertical rod being connected to a spring compressed within the trigger tube that forces the pin inwardly and that is further compressed when the button is pushed to release the pin. The height of the gateboard is adjusted by simultaneously depressing the buttons to pivot the vertical rods and thereby move the pins out of the holes, moving the gateboard to the desired height, and releasing the buttons so the pins engage the holes.

The hurdle of this invention contains a durable trigger mechanism that enables the height of the gateboard to be easily adjusted.

DETAILED DESCRIPTION OF THE INVENTION

Figure 1:
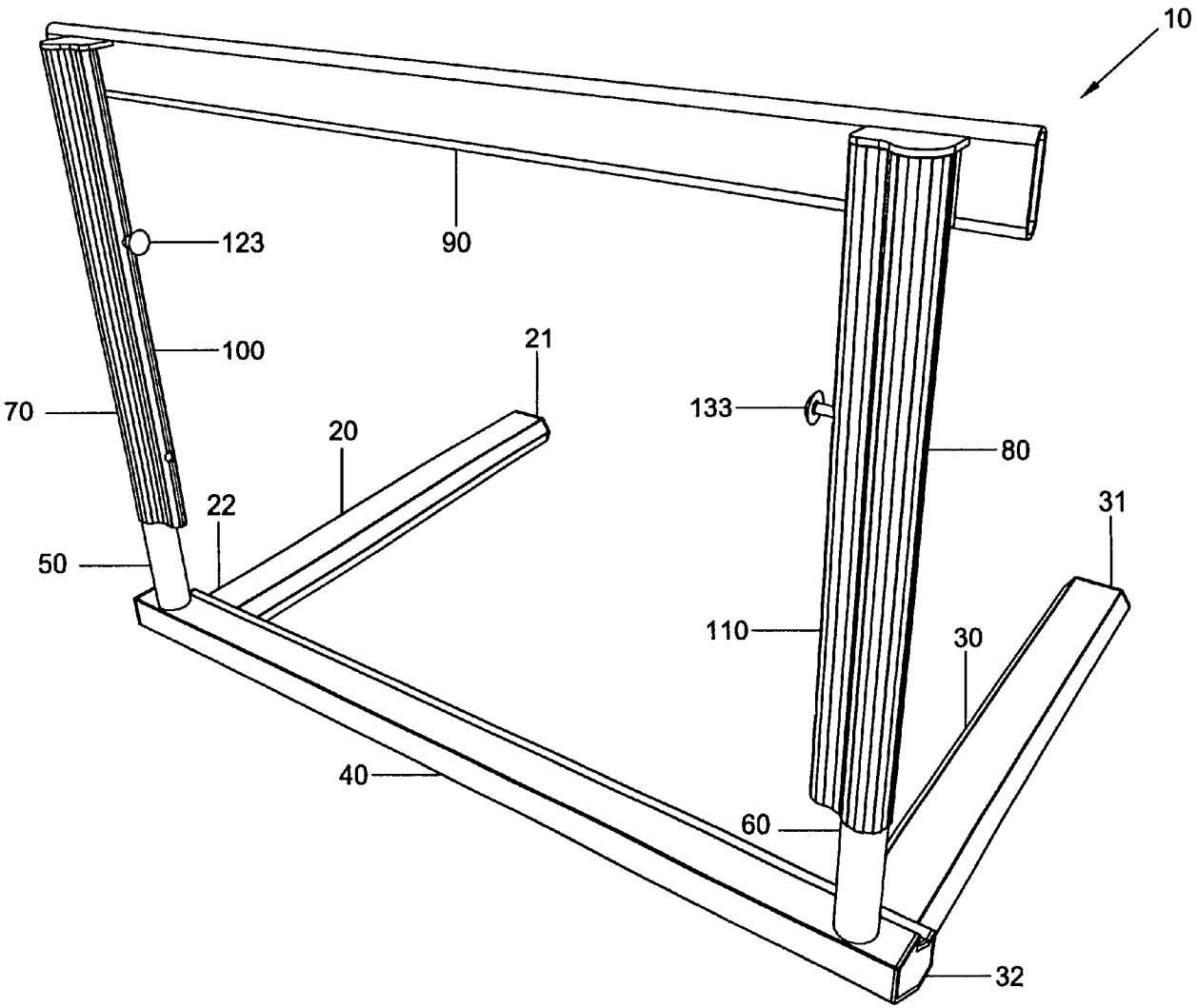
FIG. 1 is a perspective view of a hurdle of this invention.

This invention is best understood by reference to the drawings. Referring to FIG. 1, a hurdle 10 has a base with two legs 20 and 30 and a horizontal cross support 40. Two uprights 50 and 60 extend upwardly. Two telescoping tubes 70 and 80 fit over the uprights. A gateboard 90 connects the top ends of the telescoping tubes. Contiguous trigger tubes 100 and 110 are located along the inward surfaces of the telescoping tubes. The trigger tubes contain trigger mechanisms 120 and 130. In FIG. 1, the only parts of the trigger mechanisms that are visible are the buttons 123 and 133. Each component is discussed in detail below.

The size of the hurdle is standard and is generally set by a track and field governing body. It typically has a width of either about 41 inches or about 47 inches and the height of the hurdle (measured from the ground to the top of the gateboard) is adjustable between about 30 and 42 inches. The lowest setting is used for girls and the top setting is used for adult men.

The base of the hurdle contains two parallel horizontal legs 20 and 30 having a length of about 30 inches. Each leg has leading end 21 and 31 and a trailing end 22 and 32. The terms "leading" and "trailing" ends refer to the direction from which the athlete approaches the hurdle. In the preferred embodiment, the cross support connects the trailing ends of the legs. Alternatively, the cross support can be positioned between the lower ends of the upright tubes or can be omitted altogether. The legs and the cross support preferably have flat bottoms for maximum stability. The legs and cross support are preferably made of hollow extruded aluminum. As discussed below, the legs typically contain weights to achieve the desired pull over weight for the hurdle.

Uprights 50 and 60 extend upwardly from the trailing edges of the legs. The upright are preferably tubes made of hollow aluminum with a diameter of about two inches. Each upright has a plurality of holes 51 and 61 spaced apart vertically along its inward surface. The number of holes determines the number of different heights for the hurdle. In the preferred embodiment, each upright has five holes for the following categories: (1) women's low; (2) women's high; (3) men's intermediate; (4) high school boys' high; and (5) men's high.

Telescoping members 70 and 80 fit over the uprights. In the preferred embodiment, the telescoping members are cylindrical tubes. The inside diameter of the telescoping tubes is slightly greater than the outside diameter of the upright tubes so the telescoping tubes can move freely up and down, but with little play. A contiguous trigger tube 100 and 110 is located along the inward surface of each telescoping tube. As discussed below, the trigger tubes house the trigger mechanisms that are used to adjust the height of the hurdle. Each trigger tube has a hole along its inward surface out of which the buttons of the trigger mechanism extend.

A gateboard 90 connects the top of the telescoping tubes. The gateboard has a width of about three or four inches and is generally made of a synthetic polymeric material such as LEXAN polycarbonate, aluminum, steel, or wood. It can be seen that the base and the uprights form a first assembly and that the telescoping tubes and the gateboard form a second assembly. To adjust the height of the hurdle, the telescoping tubes-gateboard assembly is moved relative to the base-uprights assembly.

Figure 2:
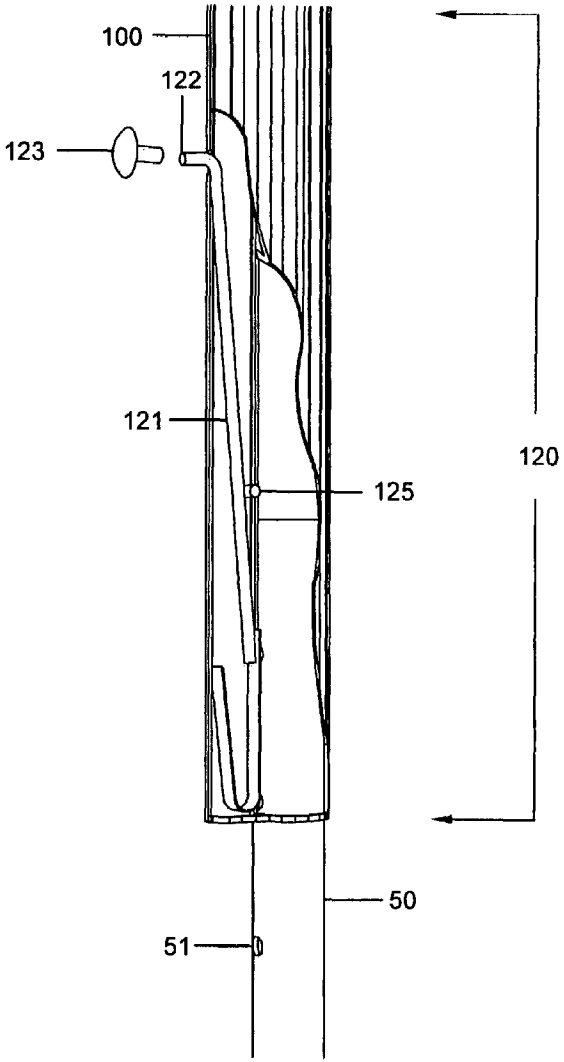
FIG. 2 is an elevation view showing the trigger mechanism.
Figure 3:
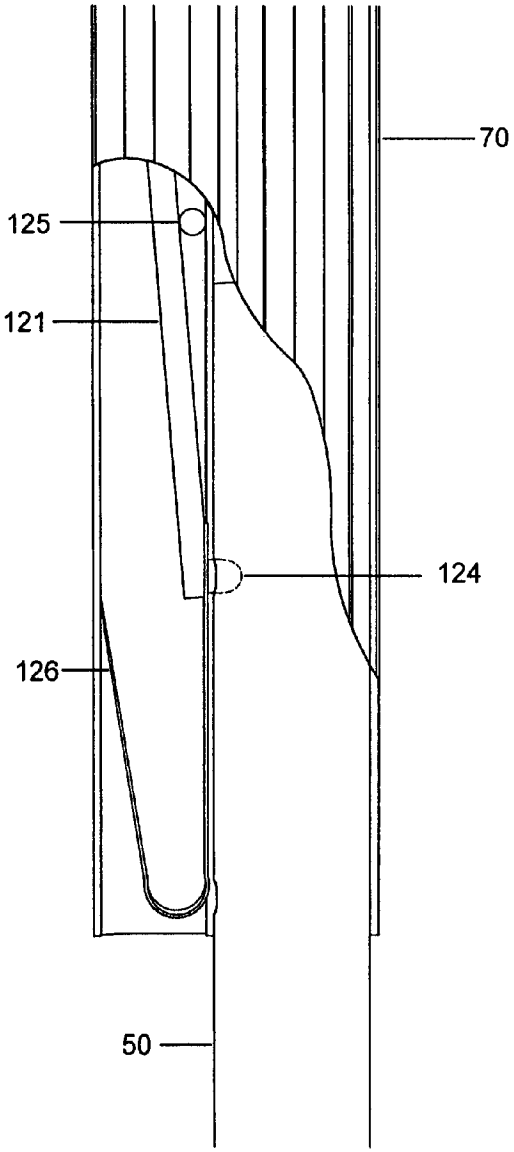
FIG. 3 is a detailed elevation view thereof.

Referring now to FIGS. 2 and 3, a trigger mechanism 120 and 130 is located inside each trigger tube. The trigger mechanisms are the means by which the position of the telescoping tubes are adjusted relative to the uprights to set the gateboard at a desired height. For simplicity, only one trigger mechanism is discussed. The trigger mechanism includes a pivoting vertical rod 121 which acts as a lever. The rod preferably has a length of about twelve inches, a diameter of about one-fourth inch, and is made of steel. The upper end 122 of the rod is inwardly directed and horizontal (perpendicular to the vertical portion). It extends out through the hole in the trigger tube. A button 123 is preferably attached to the end of the rod. The lower end of the rod is outwardly directed and horizontal. It forms a pin 124 that selectively engages one of the holes in the upright tube.

Figure 3A:
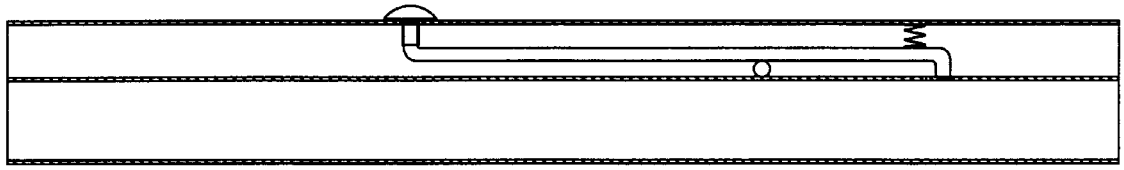
FIG. 3A is an elevation view showing an alternate trigger mechanism.

The vertical rod contains a horizontal pivot bar 125 attached midway along its outer surface. The pivot bar acts as the fulcrum for the lever. In the preferred embodiment, the pivot bar is attached about eight inches from the top of the rod. It can be seen that the pivot bar contacts the inward inside wall of the trigger tube. Attached to the lower end of the rod is a U-shaped spring 126 that is compressed within the trigger tube. It can be seen that the force of the force of the spring urges the pin inwardly to engage one of the holes in the upright tube. Other mechanisms to urge the pin inwardly are also suitable. For example, FIG. 3A illustrates a coil spring as an alternate mechanism.

The adjustment of the height of the hurdle can now be considered. To adjust the height, a person stands in between the legs and reaches over the gateboard and grips the telescoping tubes near the buttons. The buttons are then depressed simultaneously. The inward movement of the buttons cause the rods to pivot and the pins to move away from engagement with the holes in the upright tubes. The telescoping tubes-gateboard assembly is then moved to the desired position. When the desired position is reached, the buttons are released and the pins engage the appropriate holes in the upright tubes.

Figure 4:
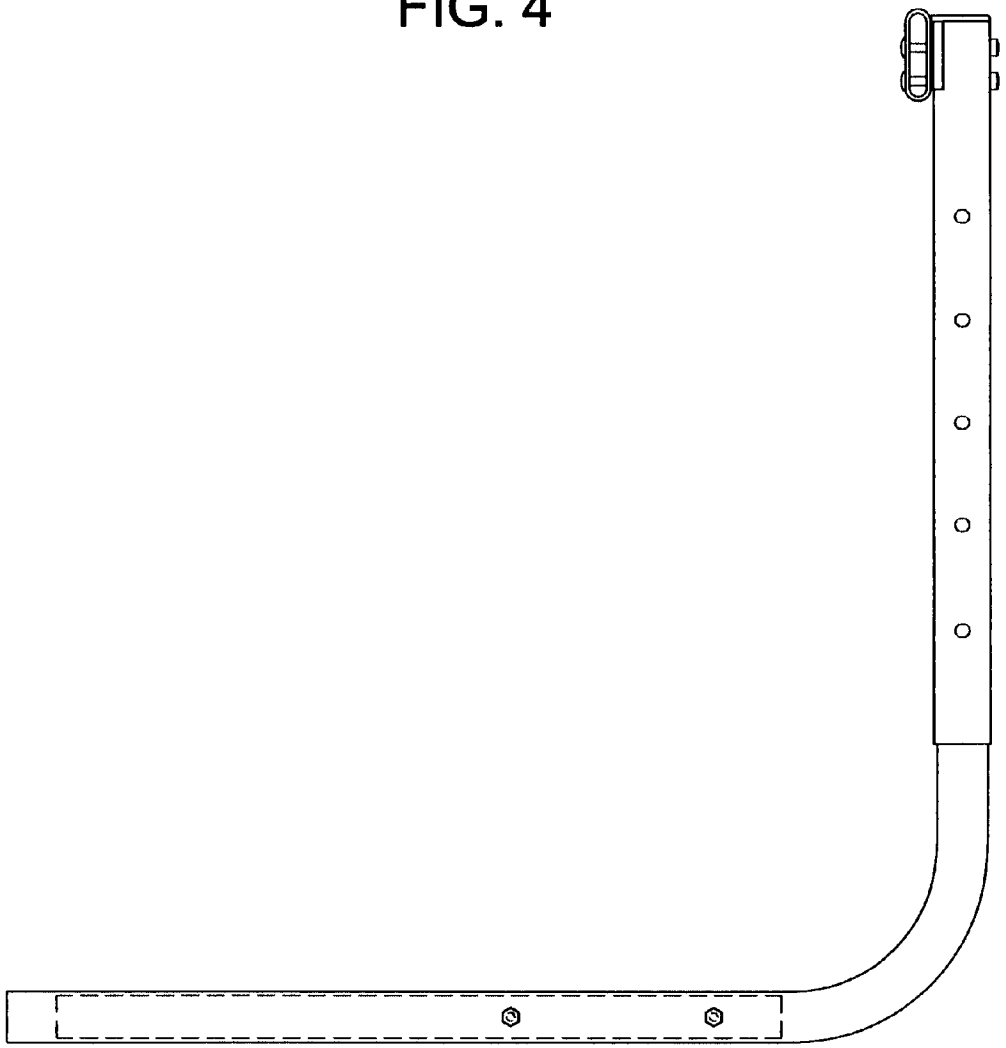
FIG. 4 is a side elevation view of a first embodiment of the hurdle of this invention having a fixed weight in the base.
Figure 5:
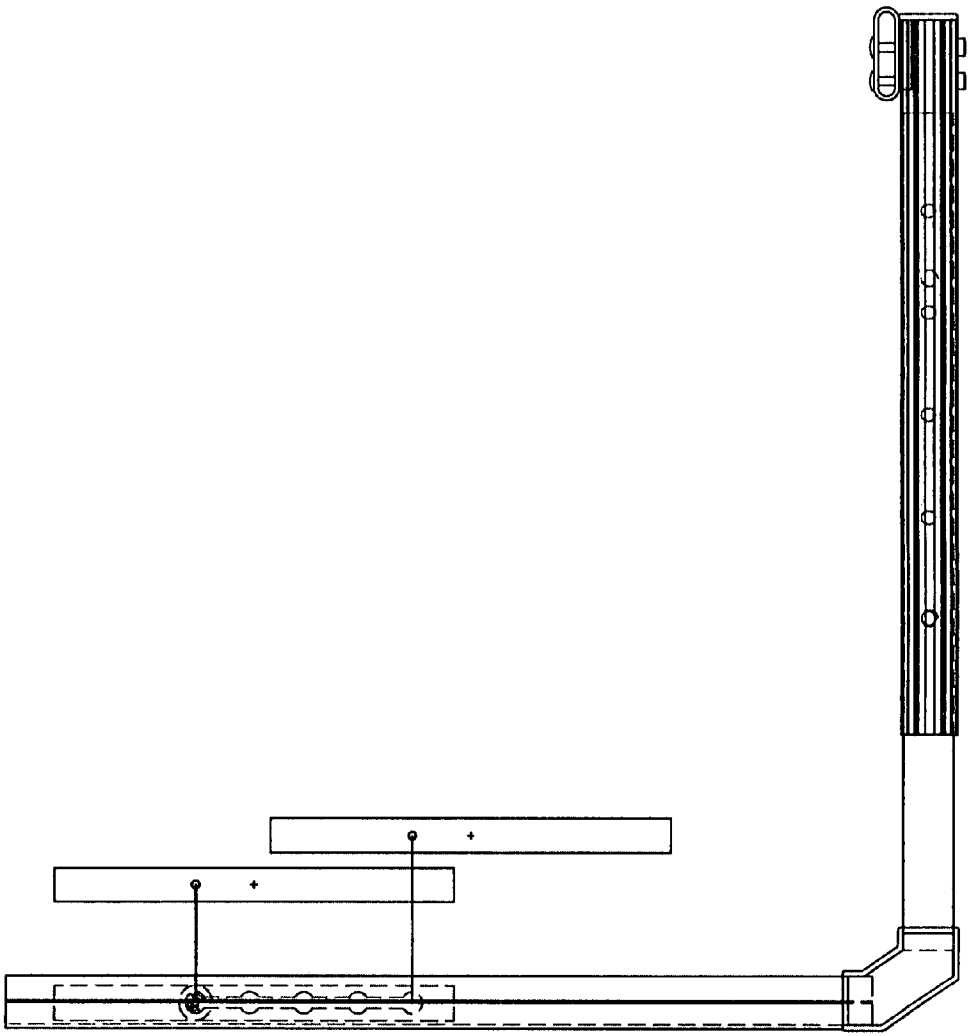
FIG. 5 is a side elevation view of a second embodiment of the hurdle of this invention having a manually adjustable weight in the base.

The movement of the gateboard may or may not be accompanied by the movement of weights 140 and 150 in the legs of the base. In the first embodiment shown in FIG. 4, the legs contain fixed weights. Accordingly, the pull over weight of the hurdle changes as the height of the hurdle changes. In the second embodiment shown in FIG. 5, the legs contain manually adjustable weights in the leg. Accordingly, to maintain a constant pull over weight, the weights in the leg are moved each time the height of the hurdle is changed.

Figures 6, 7:
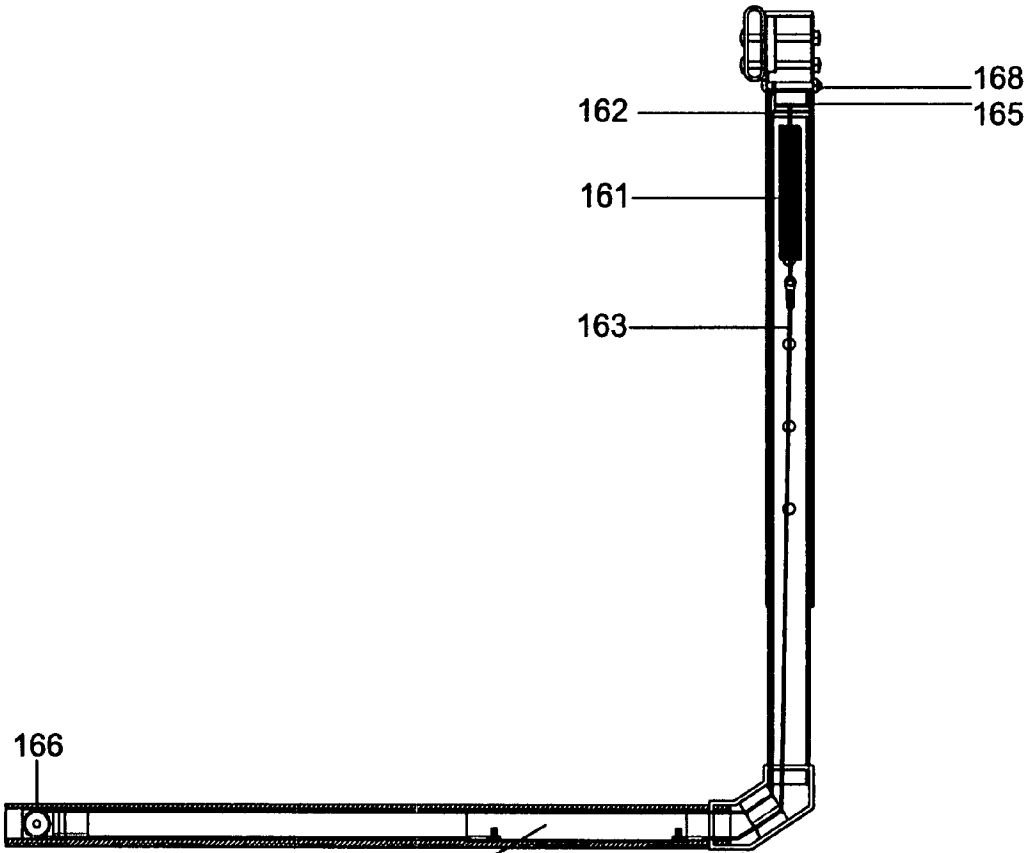
FIG. 6 is a side elevation view of a third embodiment of the hurdle of this invention having an automatic adjustable weight in the base.
FIG. 7 is a sectional view of one of the legs of the base thereof.

The third embodiment of the hurdle is shown in FIGS. 6 and 7. In this embodiment, the weights in the legs move automatically as the gateboard height is changed so that the pull over weight remains constant. The automatic movement mechanisms in each leg and upright are identical and they comprise several components. The first component of mechanism 160 is a coil spring 161 inside the upright. The upper end of the coil spring is attached to a spring pin 162 that is positioned in the upper end of the upright. The lower end of the coil spring is attached to a first cable 163 that runs downward to a pulley 164 and then horizontally to the trailing side of the weight 140. A second cable 165 runs from leading side of the weight around pulley 166, back to pulley 167, and then up to a hex bolt 168 attached to the gateboard. As the gateboard moves higher, the coil spring uncoils and the weight moves toward the leading edge of the leg (away from the uprights). As the gateboard moves lower, the coil spring coils and the weight moves toward the trailing edge (toward the uprights).

Service on the trigger mechanism and spring is easily performed because they are located in easily accessible locations at the top of the trigger tube and upright tube respectively.

We claim:

1. A hurdle comprising:

(a) a base comprising two parallel horizontal legs, each leg having a leading end and a trailing end;

(b) two uprights, each upright having an inward surface and extending upwardly from the trailing end of a leg and having a plurality of holes spaced apart vertically along its inward surface;

(c) two telescoping tubes, each tube having a top end and being adapted to fit over an upright, each tube having an inward surface and a contiguous trigger tube along its inward surface, each trigger tube having an inward surface and having a hole along its inward surface;

(d) a gateboard connecting the top ends of the telescoping tubes; and (e) a trigger mechanism inside each trigger tube, each trigger mechanism comprising a pivoting vertical rod with an inwardly directed perpendicular upper end that extends out of the hole in the trigger tube to form a button and an outwardly directed perpendicular pin at its lower end adapted to engage one of the holes in the upright, the vertical rod having a horizontal pivot bar attached midway along its outward surface, the lower end of the vertical rod being connected to a spring compressed within the trigger tube that forces the pin outwardly to engage one of the holes in the upright and that is further compressed when the button is pushed to disengage the pin from the hole; such that the height of the gateboard is adjusted by simultaneously depressing the buttons to pivot the vertical rods and thereby disengage the pins from the holes, moving the gateboard to a desired height, and releasing the buttons so the pins engage the holes.

2. The hurdle of claim 1 wherein the base additionally comprises a horizontal cross support connecting the trailing ends of the legs.

3. The hurdle of claim 2 additionally comprising a fixed weight inside each leg.

4. The hurdle of claim 2 additionally comprising a manually adjusted weight inside each leg.

5. The hurdle of claim 2 additionally comprising a movable weight in each leg and a means for automatically moving the weight inside each leg as the gateboard is moved.

6. A hurdle comprising:

(a) a base comprising two horizontal legs, each leg having a leading end and a trailing end;

(b) two uprights, each upright having an inward surface and extending upwardly from the trailing end of a leg and having a plurality of holes spaced apart vertically along its inward surface;

(c) two telescoping tubes, each tube having a top end and being adapted to fit over an upright, each tube having a contiguous trigger tube along its inward surface, each trigger tube having an inward surface and having a hole along its inward surface;

(d) a gateboard connecting the top ends of the telescoping tubes; and (e) a trigger inside each trigger tube, each trigger comprising a vertical lever with an inwardly directed perpendicular upper end that extends out of the hole in the trigger tube to form a button and an outwardly directed perpendicular pin at its lower end adapted to engage one of the holes in the upright, the lever having a fulcrum attached midway along its outward surface, the lower end of the lever being biased by a spring within the trigger tube that forces the pin outwardly to engage one of the holes in the upright and that is compressed when the button is pushed to disengage the pin from the hole; such that the height of the gateboard is adjusted by simultaneously depressing the buttons to pivot the levers and thereby disengage the pins from the holes, moving the gateboard to a desired height, and releasing the buttons so the pins engage the holes.

7. The hurdle of claim 6 wherein the base additionally comprises a horizontal cross support connecting the trailing ends of the legs.

8. The hurdle of claim 7 additionally comprising a fixed weight inside each leg.

9. The hurdle of claim 7 additionally comprising a manually adjusted weight inside each leg.

10. The hurdle of claim 7 additionally comprising a movable weight in each leg and a means for automatically moving the weight inside each leg as the gateboard is moved.

* * * * *